US005281155A

United States Patent [19]

Comerci et al.

[11] Patent Number: 5,281,155

[45] Date of Patent: Jan. 25, 1994

[54] ELECTRICAL CONNECTOR WITH ELECTROSTATIC DISCHARGE PROTECTION

[75] Inventors: Joseph D. Comerci, Elmhurst; Robert DeRoss, Naperville, both of Ill.

[73] Assignee: Molex Incorporated, Lisle, Ill.

[21] Appl. No.: 989,680

[22] Filed: Dec. 14, 1992

[51] Int. Cl.[5] ..... H01R 13/648

[52] U.S. Cl. ..... 439/107; 361/212

[58] Field of Search ..... 439/106-108, 439/650, 653, 682; 361/212

[56] References Cited

U.S. PATENT DOCUMENTS 4,711,506 12/1987 Tanaka ..... 439/108
5,002,495 3/1991 Tanaka ..... 439/108
5,066,240 11/1991 Verdun ..... 439/181
5,161,991 11/1992 Bauer ..... 439/108 X

FOREIGN PATENT DOCUMENTS 468748A 1/1992 European Pat. Off. .

*Primary Examiner*—Eugene F. Desmond
*Attorney, Agent, or Firm*—Stephen Z. Weiss

[57] ABSTRACT

A receptacle type electrical connector includes a dielectric housing having a mating face and mounting a plurality of female electrical terminals adapted for mating with a plurality of male terminals of an appropriate mating electrical component. One of the terminals is a ground terminal adapted for connection to a ground circuit. An insulative cover is mounted over the mating face of the housing and has apertures aligned with the plurality of female terminals. A conductive electrostatic discharge shield includes a plate portion sandwiched between the cover and the mating face of the housing. The shield includes apertures aligned with the plurality of female terminals. The apertures of the plate portion are dimensioned so that the male terminals will not contact the shield. A connecting portion of the shield extends from the plate portion for electrically engaging the ground terminal.

10 Claims, 2 Drawing Sheets

ELECTRICAL CONNECTOR WITH ELECTROSTATIC DISCHARGE PROTECTION

FIELD OF THE INVENTION

This invention generally relates to the art of electrical connectors and, particularly, to an electrical connector assembly which includes a conductive electrostatic discharge shield means.

BACKGROUND OF THE INVENTION

Generally, all electrical connectors are provided with an interface for electrical connection with a complementary mating connector or other electrical or electronic device or component. Common interfaces may be in a receptacle or socket type connector for receiving a second or plug type connector to complete an electrical connection therebetween. Such connectors often are used in control equipment which incorporate such electronic devices as integrated circuits which cannot withstand an electrostatic shock. In such applications, both receptacle and plug type connectors provide multiple low voltage electrical connections within relatively small areas or envelopes, particularly where numbers of low voltage electrical connections are required. Each individual electrical connector typically includes an electrical contact or terminal providing an electrical connection with a contact or terminal of the complementary connector or other electrical device. When connecting or disconnecting such components, opposite charges at the interface may result in an electrostatic discharge between the two components. In fact, electrostatic discharges can occur simply by a person touching the interface of the connector. If the discharge propagates to a contact or terminal which is electrically associated with certain integrated circuits, such as with a semiconductor or other low power electrical device, the discharge could result in the destruction of the electrical device associated with the contact or terminal to which the discharge propagates.

In order to alleviate the electrostatic discharge problem, some electrical connectors include electrostatic discharge protection. Often, this protection is provided in the form of a shield configured as a plate, bar, rod or the like located generally at the connector interface and coupled to a ground within or without the connector. Unfortunately, the provision of such electrostatic discharge shields add significantly to the costs of these types of electrical connectors. The connector housings must be provided with grooves, channels, passages and the like for mounting the discharge shields, along with similar types of passageways for directing portions of the shield to a separate ground means either incorporated in the connector itself or to an outside ground component. Such structures add significantly to the overall cost of an otherwise relatively simple electrical connector.

On the other hand, most such electrical connectors include, as one of its terminals, a ground terminal which already has means for coupling the ground terminal to an external ground. This invention is directed to a simple solution to the problems identified above, by providing a simple electrostatic discharge shield means which is coupled directly to the ground terminal, itself, and thereby avoiding all of the extraneous structural provisions for grounding the shield as is prevalent with the prior art.

SUMMARY OF THE INVENTION

An object, therefore, of the invention is to provide a new and improved electrostatic discharge system for electrical connectors.

In the exemplary embodiment of the invention, a receptacle type electrical connector is disclosed but should not be considered limiting. The connector includes a dielectric housing having a mating face and mounting a plurality of female electrical terminals adapted for mating with a plurality of male terminals of an appropriate mating electrical connector. One of the terminals is a ground terminal adapted for connection to a ground circuit. An insulative cover is mounted over the mating face of the housing and includes apertures aligned with the plurality of female terminals and through which the male terminals are inserted.

The invention contemplates the provision of a conductive electrostatic discharge shield having a plate portion sandwiched between the cover and the mating face of the dielectric housing. The shield includes apertures aligned with the plurality of female terminals, as well as the apertures in the insulative cover. The apertures of the plate portion of the shield are dimensioned so that the male terminals will not contact the shield. Connecting means are provided on the shield, extending from the plate portion thereof, for electrical connection directly to the ground terminal. Therefore, the electrostatic discharge shield is conductively coupled to the ground circuit through the ground terminal, and all other extraneous grounding means for the shield are obviated.

As disclosed herein, the dielectric housing includes a passage for receiving the ground terminal. The connecting means of the shield extends into the passage for electrical engagement with the ground terminal. In the preferred embodiment, the shield is stamped and formed from sheet metal material, and the connecting means is provided by a pair of spring arms embracing the ground terminal. The passage has one open end at the mating face of the housing for receiving a male ground terminal of the mating electrical connector, along with a second open end through which a terminal tail of the ground terminal extends from the housing for connection to the ground circuit.

Other objects, features and advantages of the invention will be apparent from the following detailed description taken in connection with the accompanying drawings.

BRIEF DESCRIPTION OF THE DRAWINGS

The features of this invention which are believed to be novel are set forth with particularity in the appended claims. The invention, together with its objects and the advantages thereof, may be best understood by reference to the following description taken in conjunction with the accompanying drawings, in which like reference numerals identify like elements in the figures and in which:

DETAILED DESCRIPTION OF THE PREFERRED EMBODIMENT

Figure 1:
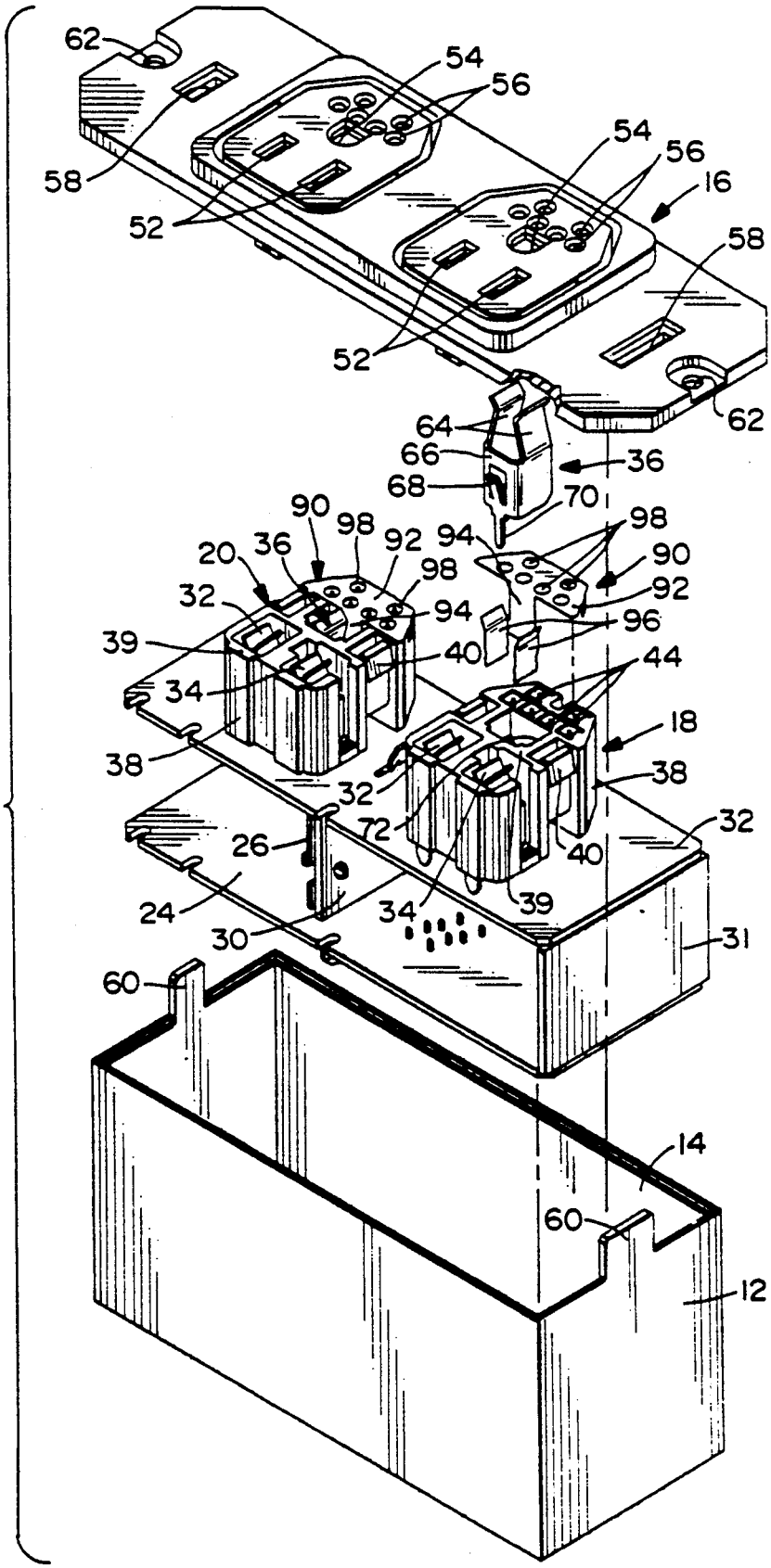
FIG. 1 is an exploded perspective view of an electrical connector assembly embodying the electrostatic discharge shield of the invention.

Referring to the drawings in greater detail, and first to FIG. 1, the electrostatic discharge shield means of the invention is embodied in an electrical connector assembly, generally designated 10, which includes a boxlike housing 12 having an open top 14 as viewed in FIG. 1. At this point, it should be noted that electrical connector assembly 10 is of a type disclosed in copending application Ser. No. 07/981,150, filed Nov. 24, 1992, assigned to the assignee of this invention, and which is incorporated herein by reference. Suffice it to say, if connector assembly 10 is used as a wall receptacle, such as in a "smart house" application, open top 14 of housing 12 actually would be an open front end of the housing. All of the components of connector assembly 10 are mounted within housing 12, and a face cover, generally designated 16, is positioned onto the housing to close the open front end thereof.

More particularly, electrical connector assembly 10 includes a pair of receptacle modules, generally designated 18 and 20. The receptacle modules are mounted on and electrically coupled to a first printed circuit board 22. The first printed circuit board is electrically coupled to a second printed circuit board 24 spaced from and generally parallel to first circuit board 22. A conductive ground plate 26 is electrically coupled or grounded between circuit boards 22 and 24 and mechanically supports the circuit boards in their spaced, generally parallel relationship. Ground plate 26 is coupled to a third printed circuit board 30. A fourth printed circuit board 31 provides circuitry between circuit boards 22 and 24. It should be understood that all of the printed circuit boards 22, 24, 30 and 31 have appropriate circuit traces thereon, as is well known in the art, and including a commoning ground circuit therethrough from receptacle modules 18 and 20.

Both receptacle modules 18 and 20 are substantially identical and include a conventional three-pronged terminal configuration including a "hot" terminal 32, a neutral terminal 34 and a ground terminal, generally designated 36. The terminals are female terminals for receiving complementary male terminals or pins of a mating complementary connector (not shown). Each receptacle module 18 and 20 includes a dielectric housing 38, such as molded of plastic material, having a mating face 39 and including latch arms 40 for latching to face cover 16. Terminals 32, 34 and 36 can be considered power terminals for accommodating 120 volt power, for instance, but each housing 38 includes a plurality of passages 44 within which are mounted appropriate female data terminals (not visible in the drawings). The data terminals are part of low voltage circuitry for transmitting on the order of 5/12 volt data signals.

Face cover 16 is generally flat and has two arrays of apertures therethrough corresponding to and aligned with the terminal/passage array of receptacle modules 18 and 20. It can be seen in FIG. 1 that apertures 52 will be aligned with terminals 32 and 34 of the receptacle modules, an aperture 54 will be aligned with each ground terminal 36, and apertures 56 will be aligned with data terminal passages 44 of the receptacle modules. The face cover also includes a pair of slots 58 for receiving a pair of tabs 60 projecting upwardly from the top of housing 12. Lastly, the face cover includes a pair of mounting holes 62 at opposite ends thereof for facilitating mounting the entire electrical connector assembly 10 to a support structure, such as in an opening in a wall or the like.

Figure 2:
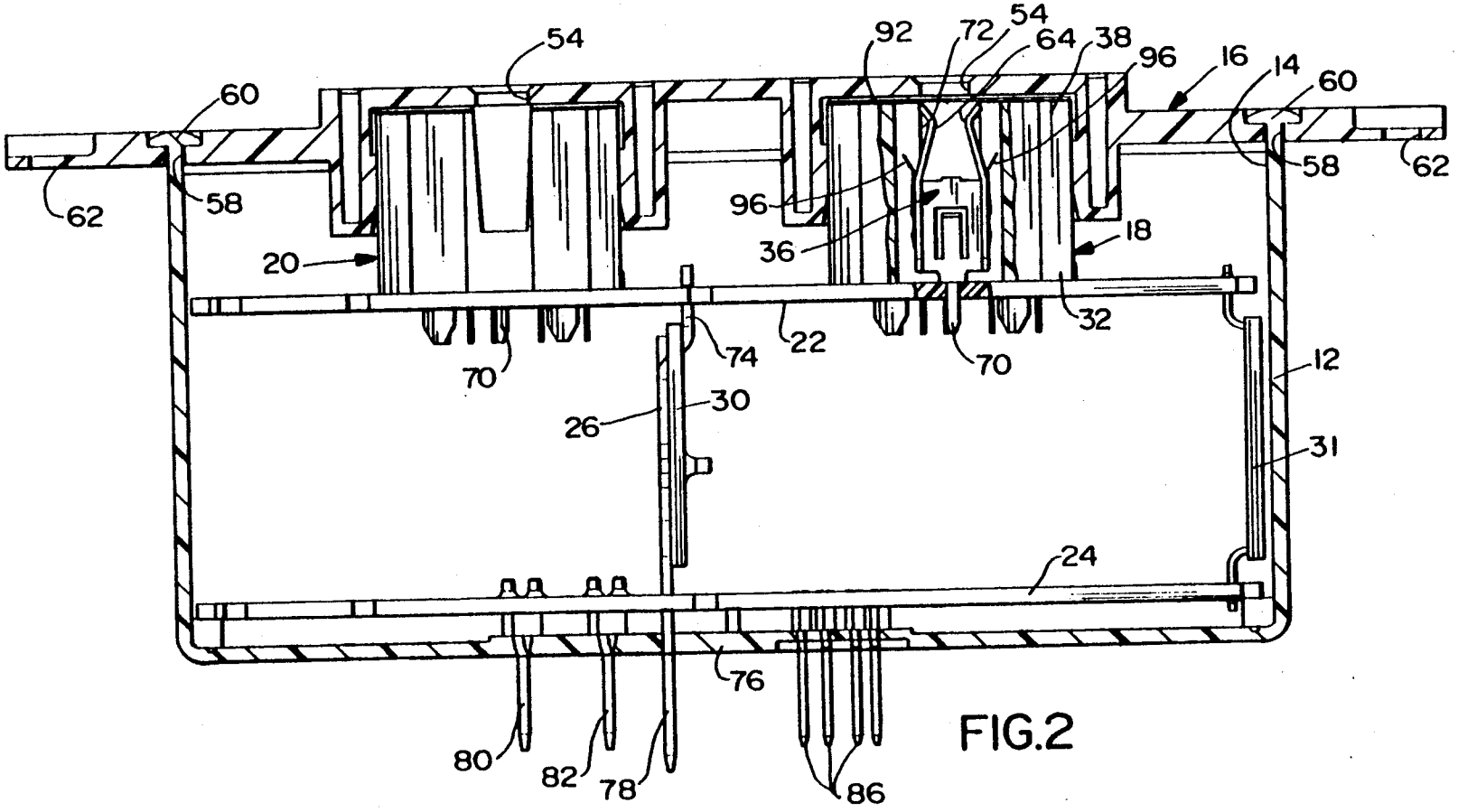
FIG. 2 is a section through the connector in assembled condition and partially cut away to show the disposition of the connecting means of the shield and one of the ground terminals.

Referring to FIG. 2 in conjunction with FIG. 1, it can be seen that all of the components including receptacle modules 18 and 20, printed circuit boards 22, 24, 30 and 31, and ground plate 26 are encased within housing 12. Face cover 16 is mounted onto the housing to close open end 14 thereof . Tabs 60 at the top of the housing project through slots 58 of the face cover and are secured in assembly by ultrasonic staking. It can be seen that the ends of the face cover project beyond the housing whereby holes 62 in the face cover can be used to mount the electrical connector assembly to an appropriate support structure.

Referring back to FIG. 1, each ground terminal 36 for each receptacle module 18 and 20 may be stamped and formed from sheet metal material. Each ground terminal includes a pair of resilient arm portions 64 defining a female receptacle for receiving an appropriate male ground terminal from the complementary connector. The arm portions are joined to an intermediate portion 66 which includes a latch tab 68 for appropriately retaining the ground terminal in its respective housing 38. Each ground terminal also includes a depending tail portion 70.

Now, referring to FIG. 2 in conjunction with the above description of each ground terminal 36 in FIG. 1, it can be seen that each ground terminal is mounted in a passage 72 in its respective housing 38. The passage has a top open end aligned with a respective aperture 54 in face cover 16. Tail 70 of the ground terminal projects through a hole in printed circuit board 22 for soldering to a ground trace on the board or in the hole. The ground trace is coupled, as at 74, to a ground trace on printed circuit board 30, which, in turn, is electrically coupled to ground plate 26. A tail portion 78 of the ground plate extends through printed circuit board 24 and through a bottom wall 76 of housing 12, for connection to an external ground circuit. Therefore, it can be seen that each ground terminal 36 is coupled through the described circuitry to an appropriate external ground circuit.

Still referring to FIG. 2, a "hot" terminal 80 and a neutral terminal 82 extend from printed circuit board 24 through wall 76 of housing 12 for interconnection with appropriate exterior power circuitry. Terminals 80 and 82 are electrically coupled through printed circuit board 24, through printed circuit board 31, and printed circuit board 22, to terminals 32 and 34 of the respective receptacle modules 18 and 20. Data terminals 86 also extend from printed circuit board 24 through wall 76 of housing 12 for connection to appropriate external circuitry. Like power terminals 80 and 82, data terminals 86 are electrically coupled through printed circuit board 24, printed circuit board 31 and printed circuit board 22 to the data terminals in passages 44 (FIG. 1) of the respective receptacle modules 18 and 20.

Referring back to FIG. 1, the invention is incorporated in a conductive electrostatic discharge shield, generally designated 90, particularly associated with the low voltage female data terminals located in passages 44 of each dielectric housing 38 of each receptacle module 18 and 20. The electrostatic discharge shield includes a plate portion 92 joined by a depending leg portion 94 to a pair of resilient arm portions 96. The shield may be fabricated of stamped and formed sheet metal material whereby arm portions 96 comprise spring arms for embracing a respective one of the ground terminals 36, as described below in relation to FIG. 2. Plate portion 92 of the shield rests upon the top of dielectric housing 38 and is sandwiched between the housing and face cover 16. The plate portion has a plurality of apertures 98 aligned with apertures 56 in the face cover and also aligned with data terminal passages 44 in the dielectric housing. It should be noted that apertures 98 are dimensioned so that the male terminals of the complementary mating connector will not contact the edges of the apertures, i.e. so that the male terminals do not contact electrostatic discharge shield 90. Leg portion 94 and spring arms 96 are insertable into passage 72 which receives ground terminal 36.

Now, referring to FIG. 2, and particularly the broken-away portion of dielectric housing 38 of receptacle module 18, it can be seen that, when the connector assembly is in assembled condition with ground terminal 36 inserted into its respective passage 72, spring arms 96 of conductive electrostatic discharge shield 90 (FIG. 1) embrace the sides of the ground terminal and establish direct electrical connection between the electrostatic discharge shield and the ground terminal. Following the circuit-flow description above, it thereby can be understood that the electrostatic discharge shield is coupled to ground terminal 78 projecting from wall 76 of housing 12, ground terminal 78 being adapted for connection to an appropriate exterior ground circuit. By interconnecting the electrostatic discharge shield directly to ground terminal 36, all extraneous connecting means for otherwise grounding the shield to some external ground circuit is obviated. In essence, utilization is made of the existing ground circuitry of the entire electrical connector assembly 10 for grounding the electrostatic discharge shield. Therefore, the shield need only extend into the connector assembly sufficiently for engaging the respective ground terminal 36.

The assembly of electrostatic discharge shield 90 also is facilitated by the concepts of the invention. As can be seen in FIG. 1, depending leg portion 94 and spring arms 96 simply are inserted into the top of passage 72 which receives the respective ground terminal 36. The ground terminal then is inserted into the passage to the position shown in FIG. 2, whereupon spring arms 96 of the shield automatically interconnect with the sides of the ground terminal.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

We claim:

1. A receptacle type electrical connector, comprising:

a dielectric housing having a mating face and a plurality of female electrical terminals mounted therein and adapted for mating with a plurality of male terminals of an appropriate mating electrical component and including a male ground terminal, one of the female terminals being a ground terminal adapted for connection to a ground circuit and adapted to mate with the male ground terminal;

an insulative cover mounted over the mating face of the housing and having apertures aligned with the plurality of female terminals; and a conductive electrostatic discharge shield including a plate portion sandwiched between the cover and the mating face of the housing and including apertures aligned with at least some of the plurality of female terminals, the apertures of the plate portion being dimensioned so that said male terminals do not contact the shield, and connecting means extending from the plate portion for electrically engaging the female ground terminal.

2. A receptacle type electrical connector as set forth in claim 1 wherein said dielectric housing includes a passage for receiving the female ground terminal, and said connecting means of the shield extends into the passage in engagement with the female ground terminal.

3. A receptacle type electrical connector as set forth in claim 2 wherein said shield is stamped and formed from sheet metal material, and said connecting means comprises an arm portion located in the passage.

4. A receptacle type electrical connector as set forth in claim 2 wherein said connecting means include a pair of spring arms embracing the ground terminal.

5. A receptacle type electrical connector as set forth in claim 2 wherein said passage has a first open end at the mating face of the housing for receiving the female ground terminal and a second open end through which a terminal end of the female ground terminal extends from the housing for connection to said ground circuit.

6. A receptacle type electrical connector as set forth in claim 2 wherein said ground terminal includes a terminal portion projecting from the passage for connection to said ground circuit.

7. In an electrical connector which includes a dielectric housing and a plurality of female terminals mounted therein, the housing having a mating end for mating with a complementary connector component, one of the female terminals being a ground terminal adapted for connection to a ground circuit and adapted to mate with a male ground terminal from said complementary connector component, and a conductive electrostatic discharge shield at the mating end of the housing, wherein the improvement comprises said dielectric housing including a passage for receiving the female ground terminal from said mating end, and said connecting means of the shield extending into the passage from said mating end in engagement with the female ground terminal and said electrostatic discharge shield including a connecting means for electrical connection directly to the female ground terminal.

8. In an electrical connector as set forth in claim 7 wherein said shield is stamped and formed from sheet metal material, and said connecting means comprises an arm portion located in the passage.

9. In an electrical connector as set forth in claim 7 wherein said passage has an open end at the mating end of the housing and into which the male ground terminal is inserted, and the connecting means of the electrostatic discharge shield is structured for insertion into the open end of the passage into direct connection with the female ground terminal within the passage.

10. In an electrical connector which includes a dielectric housing and a plurality of female terminals mounted therein, the housing having a mating end for mating with a complementary connector component, one of the female terminals being a ground terminal adapted for connection to a ground circuit and adapted to mate with a mate with a male ground terminal from said complementary connector component, and a conductive electrostatic discharge shield at the mating end of the housing, wherein the improvement comprises said electrostatic discharge shield including a connecting means for electrical connection directly to the female ground terminal.

* * * * *